US008312659B2

(12) United States Patent
Emde

(10) Patent No.: US 8,312,659 B2
(45) Date of Patent: Nov. 20, 2012

(54) HAND GUN

(75) Inventor: Dietmar Emde, Arnsberg (DE)

(73) Assignee: German Sport Guns GmbH, Enge-Höingen (DE)

( * ) Notice: Subject to any disclaimer, the term of this patent is extended or adjusted under 35 U.S.C. 154(b) by 148 days.

(21) Appl. No.: 12/926,426

(22) Filed: Nov. 17, 2010

(65) Prior Publication Data

US 2011/0107638 A1 May 12, 2011

(30) Foreign Application Priority Data

Nov. 12, 2009 (DE) ..... 10 2009 057 866

(51) Int. Cl.
*F41A 17/00* (2006.01)

(52) U.S. Cl. ..... 42/70.01; 42/70.02; 42/7

(58) Field of Classification Search ... 42/7, 70.01–70.11
See application file for complete search history.

(56) References Cited

U.S. PATENT DOCUMENTS

| | | | | |
|---|---|---|---|---|
| 1,376,165 | A * | 4/1921 | Rosebush | 89/137 |
| 2,139,203 | A * | 12/1938 | Petter | 89/132 |
| 3,670,442 | A * | 6/1972 | Kennedy et al. | 42/70.08 |
| 4,589,327 | A * | 5/1986 | Smith | 89/148 |
| 5,036,612 | A * | 8/1991 | Jennings | 42/70.08 |
| 6,256,919 | B1 * | 7/2001 | Brazeau | 42/70.11 |
| 6,286,240 | B1 * | 9/2001 | Collins | 42/70.08 |
| 6,405,631 | B1 * | 6/2002 | Milek | 89/139 |
| 6,442,880 | B1 * | 9/2002 | Allan | 42/70.08 |
| 6,457,271 | B1 | 10/2002 | Vaid et al. | |
| 6,510,639 | B2 | 1/2003 | McMoore | |
| 6,865,839 | B2 | 3/2005 | Bantle et al. | |
| 2002/0088159 | A1 * | 7/2002 | McMoore | 42/70.08 |
| 2005/0246933 | A1 | 11/2005 | McGarry | |
| 2006/0080881 | A1 * | 4/2006 | Cuprin et al. | 42/70.02 |
| 2008/0163531 | A1 * | 7/2008 | Zukowski et al. | 42/21 |
| 2008/0222935 | A1 * | 9/2008 | Christiansen | 42/70.06 |
| 2012/0085010 | A1 * | 4/2012 | Cook | 42/7 |

FOREIGN PATENT DOCUMENTS

| | | |
|---|---|---|
| AT | 138112 | 6/1934 |
| DE | 518372 | 2/1932 |
| DE | 10136287 | 2/2003 |
| DE | 10 2007 011 504 A1 | 9/2008 |
| DE | 102007011504 A1 | 9/2008 |
| EP | 0278795 A1 | 8/1988 |
| EP | 0461 784 A1 | 12/1991 |
| EP | 0461784 A1 | 12/1991 |
| EP | 1281924 A1 | 2/2003 |

* cited by examiner

*Primary Examiner* — Samir Abdosh
(74) *Attorney, Agent, or Firm* — Welsh Flaxman & Gitler LLC

(57) ABSTRACT

The present invention relates to a hand gun having at least one exchangeable magazine for cartridges, able to be inserted from below into a grip piece of the weapon. According to the invention, a security element is arranged in the grip piece of the weapon, which with the magazine removed blocks a grip security arrangement of the weapon on the grip piece and which on insertion of the magazine is acted upon by an element arranged on the magazine such that it moves within the grip piece, wherein through this displacement the blocking of the grip security arrangement is released. In addition, this hand gun can have a firing pin security arrangement, which blocks a movement of the firing pin on non-actuation of the trigger, wherein a recess is provided in the firing pin, and a firing pin security element, guided displaceably in this recess, which on actuation of the trigger of the weapon is acted upon directly by an arm of a swivel part connected with the trigger, and is displaced into a security release position.

9 Claims, 3 Drawing Sheets

HAND GUN

BACKGROUND OF THE INVENTION

The present invention relates to a hand gun comprising at least one exchangeable magazine for cartridges which are to be inserted from below into a grip piece of the weapon.

For cartridges with an ignition rim, it is known from the current art to use magazines in which the cartridges initially lie one over another in a staggered arrangement with intersecting axes, wherein the cartridges are then guided in the magazine towards the upper region of the magazine such that they are aligned in the same direction and wherein the cartridges then assume a graduated arrangement at the upper end of the magazine, such that the uppermost cartridge lies with its ignition rim in the firing direction in front of the ignition rim of the cartridge situated therebeneath, because it is only then guaranteed that the respectively uppermost cartridge arrives in a controlled manner into the firing channel. A magazine for hand guns of the said type is described for example in EP 0 461 784 A1. The magazine is provided, in particular, for small-caliber weapons, in which such cartridges with an ignition rim are used. The magazine is inserted from the underside into an opening, provided for this, of the grip piece. In this known weapon, no specific magazine security arrangement is provided.

From DE 10 2007 011 504 A1 a hand gun with a magazine security arrangement is known, comprising a security element which is held by the magazine pressed against the force of a spring into an unsecured position, wherein after removal of the magazine, the security element is moved by the elastic force in the longitudinal direction of the weapon into a position which blocks the trigger, so that when the magazine is not inserted, no shot can be fired. However, this arrangement is for a different type of weapon, namely one in which the magazine is situated separately in the firing direction at a distance in front of the trigger and therefore the magazine is not inserted into the grip piece. This construction for a magazine security arrangement is therefore not able to be used in a hand gun of the type of the present invention.

It is an object of the present invention to provide a magazine security arrangement which is arranged in a structurally simple manner for a hand gun, which ensures that a shot can only be fired by the trigger when a magazine is inserted into the grip piece.

SUMMARY OF THE INVENTION

According to the invention, a security element is arranged in the grip piece of the weapon, which when the magazine is removed blocks a grip safety arrangement of the weapon on the grip piece and which on insertion of the magazine is acted upon by an element arranged on the magazine such that it moves inside the grip piece, wherein by this movement the blocking of the grip safety arrangement is released.

The solution, according to the invention, makes it possible to prevent the grip security arrangement from being pressed in when the magazine is not inserted. Thereby, in this state, the trigger remains blocked and no shot can be fired.

According to a preferred embodiment of the present invention, provision is made that the displaceable security element has an engagement element which is associated with the element preferably projecting on the magazine, and in the insertion position of the magazine is acted upon by this projecting element.

This engagement element, on the displaceable security element, can be, for example, a projecting element; in particular a cam, a spring or a projection, and the corresponding projecting element on the magazine can be, for example, a projection, a nose or elevation. However, other expedient structural solutions are also conceivable, which comprise an element which is able to be acted upon on the magazine, which strikes in any form on the security element and entrains this over a distance and displaces inside the grip piece, preferably in a linear displacement movement. A tilting movement or swivelling movement of the security element inside the grip piece is likewise readily conceivable, which then leads to the release of the grip security arrangement when the magazine is inserted.

According to a possible preferred further embodiment of the solution to the problem according to the invention, the projecting element is arranged for instance in the region facing the rear end of the weapon and projects there. The security element is preferably a plate-like part, a security plate which is guided displaceably, tiltably or swivellably in the grip piece by guide means. The projecting element is preferably situated rather in a rear region in the insertion direction on the magazine, in order to ensure that the striking on the security element and hence the releasing of the security arrangement, as far as possible only takes place towards the end of the insertion of the magazine, as far as possible only when the magazine is largely fully inserted.

A preferred further embodiment of the solution to the problem, according to the invention, makes provision that a blocking element is situated on the security element at a distance from the engagement element, preferably arranged in the opposite end region of the security element, whereby this blocking element is arranged rather in the upper region of the grip piece, in any case at a height in which the grip safety arrangement is situated on the grip piece of the weapon, with which the blocking element cooperates. For example, a type of cam or projection of the security element can serve as a blocking element, which on displacement of the security element slips into a depression or a lower-lying or recessed region on the inner side of the grip piece, whereby the blocking of the grip safety arrangement is cancelled.

In addition, it is an object of the present invention to make a firearm of the type described above even more secure. A preferred further development of the invention, or respectively a variant of the solution according to the invention therefore makes provision that the hand gun according to the invention preferably additionally, or if applicable also alternatively to the magazine security arrangement, has a firing pin security arrangement, which blocks a movement of the firing pin when the trigger is not actuated, wherein a recess is provided in the firing pin and a firing pin security element guided displaceably in this recess, which on actuation of the trigger of the weapon is acted upon directly by an arm of a swivel part which is connected with trigger, and is displaced into a security release position.

The hand gun according to the invention can be used, for example, in a changeover system, which comprises a first complete weapon which is only intended for a smaller caliber and in external appearance and in external dimensions is largely identical to a weapon of the same type of construction provided for a larger caliber, wherein this complete small-caliber weapon has a grip piece with a security arrangement against interchanging. In this case, the user can acquire a complete weapon for the smaller caliber, the components of which he can remove from this weapon, if required, and can mount them onto an existing weapon for a larger caliber. The advantage compared with the known systems consists in that the user then also has a complete small-caliber weapon which, if required, is immediately able to function without conversion. According to a further development of the invention, a security arrangement against interchanging of the magazine, which prevents an insertion of a magazine of the large-caliber weapon, is situated on the grip piece of the small-caliber weapon in the region of the magazine mounting.

It is particularly preferred if such a changeover system comprises a second complete weapon which is intended for the larger caliber, wherein on this second weapon, by interchanging, the barrel and/or the magazine of the first weapon is able to be applied, which is intended for the smaller caliber. The user then has two complete weapons of different calibers, able to function and ready to fire. If required, the large-caliber weapon can also be converted into a small-caliber weapon by exchange of the barrel and/or magazine. A "downgrading" of the large-caliber weapon is therefore possible. Vice versa, however, an "upgrading" of the small-caliber weapon is not possible, because this is prevented by an interchange security arrangement on the small-caliber weapon. The small-caliber weapon, largely identical to a large-caliber weapon in the type of construction and in the external appearance, can for example be a weapon of the Colt 1911 type.

Further advantages of the invention will become apparent from the following detailed description.

BRIEF DESCRIPTION OF THE DRAWINGS

The present invention is described in further detail below with the aid of example embodiments with reference to the attached drawings, in which are shown.

DETAILED DESCRIPTION OF THE INVENTION

Figure 4:
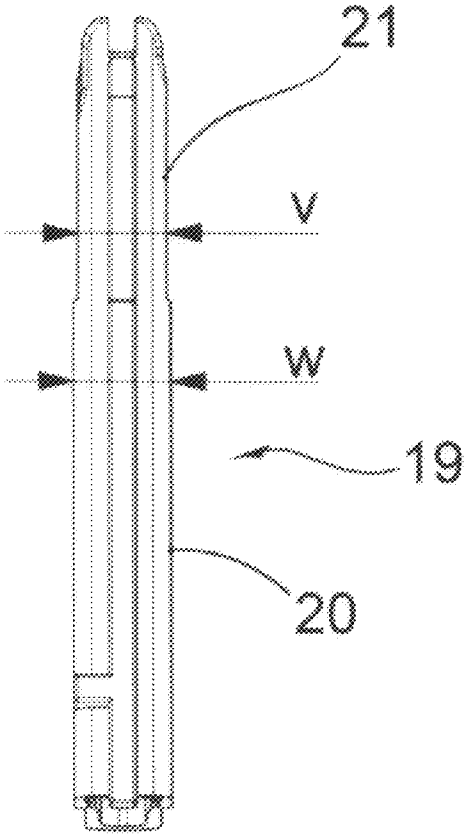
FIG. 4 a frontal view of a magazine of a weapon according to the invention, which is able to be inserted into the magazine mounting of the grip piece illustrated in FIG. 3.
Figure 3:
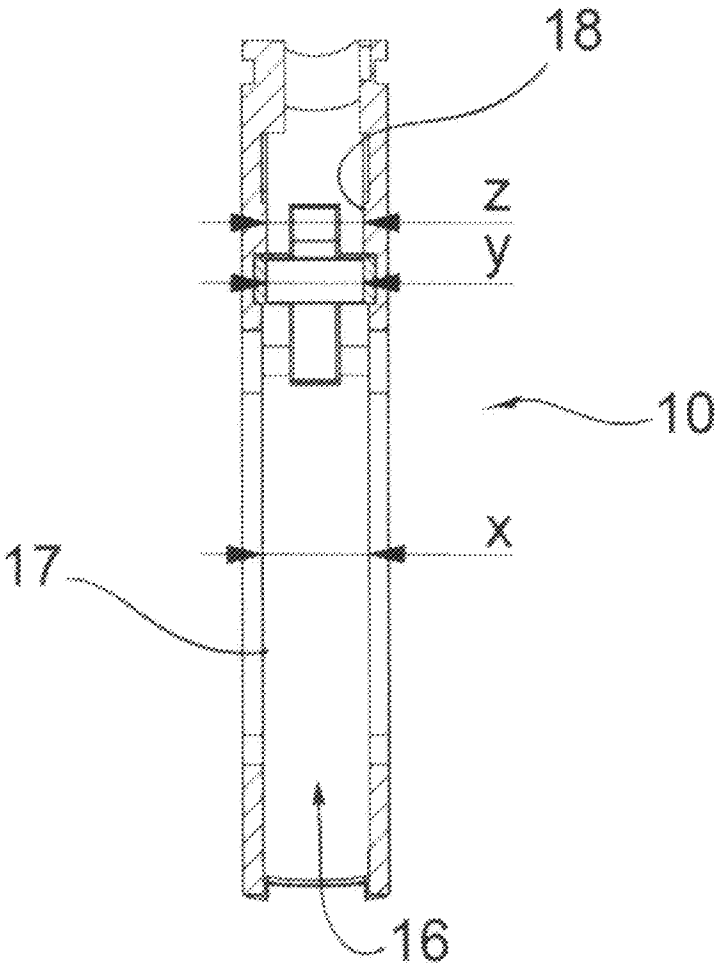
FIG. 3 a diagrammatically simplified vertical section through the grip piece of a weapon according to the invention in transverse direction with the magazine removed.

Firstly, reference is made to FIGS. 3 and 4. FIG. 3 shows the vertical section in transverse direction through the grip piece 10 of the weapon with the magazine 19 removed (see FIG. 4, in which the magazine 19 is shown in frontal view). The magazine 19 can be inserted from below into the magazine mounting 16 of the grip piece 10, which magazine holds a store of cartridges. The magazine mounting 16 of this grip piece 10 is designed here so that only magazines of a smaller caliber can be inserted, so that it is ensured that only the small-caliber ammunition is fired with this grip piece.

For this, a specific embodiment of magazine mounting and magazine is provided, which are both coordinated with each other so that only the small-caliber magazine 19 can be inserted. Externally, however, the weapon looks very similar to a large-caliber weapon which is commonly used on the market, so that the user can use the small-caliber weapon in a changeover system with an existing large-caliber weapon, which enables him for example to insert the small-caliber magazine into the large-caliber weapon, in order to fire with this, for example more favorable, ammunition for training purposes.

In FIG. 3 it can be readily seen that the magazine mounting 16 in the interior of the grip piece 10 has a lower and rear section 17, in the insertion direction of the magazine, in which the greatest insertion width (designated by "x") is provided, which in this case corresponds to the original insertion width for magazines of a weapon of a larger caliber. In an upper section, i.e. in a front section 18 in the insertion direction of the magazine, the width of the magazine mounting, on the other hand, is smaller than in the section 17. This smaller width is designated by "y" or respectively "z". It is sufficient if the reduction in the insertion width is relatively slight, in order to prevent a wider magazine, which is provided for a larger caliber, from being inserted fully into the magazine mounting of the grip piece. This wider magazine would only be able to be inserted up to the start of the upper section 18, which lies approximately at a height between the trigger arms of the grip piece.

In FIG. 4 the magazine 19 is illustrated, which is provided for ammunition with a smaller caliber and which is embodied so that it can be inserted fully into the magazine mounting 16 of the grip piece 10 illustrated in FIG. 3. This magazine has two sections which are different in their width, namely a lower, wider section 20 and an upper, narrower section 21. Through this narrower section 21, where the latter begins on the magazine respectively externally two small shoulders are formed. The width of the magazine 19 in the lower, wider section 20 is designated by "w" and the small width in the upper section 21 is designated by "v". These dimensions are selected so that the narrower, upper section 21 fits into the upper section 18 of the magazine mounting 16 (see FIG. 3), whereas the wider, lower section 20 is able to be inserted in an approximately fitting manner into the wider, lower section 17 of the magazine mounting.

The magazine according to FIG. 4, provided for the ammunition having a smaller caliber, can of course also be inserted into a magazine mounting of the weapon provided for the larger caliber, because it has a width lower than "x" over the entire length of the magazine mounting. Vice versa, however, it is not possible to insert the magazine provided for the larger caliber into the grip piece according to FIG. 3 with the upper narrower magazine mounting 16.

Figure 2:
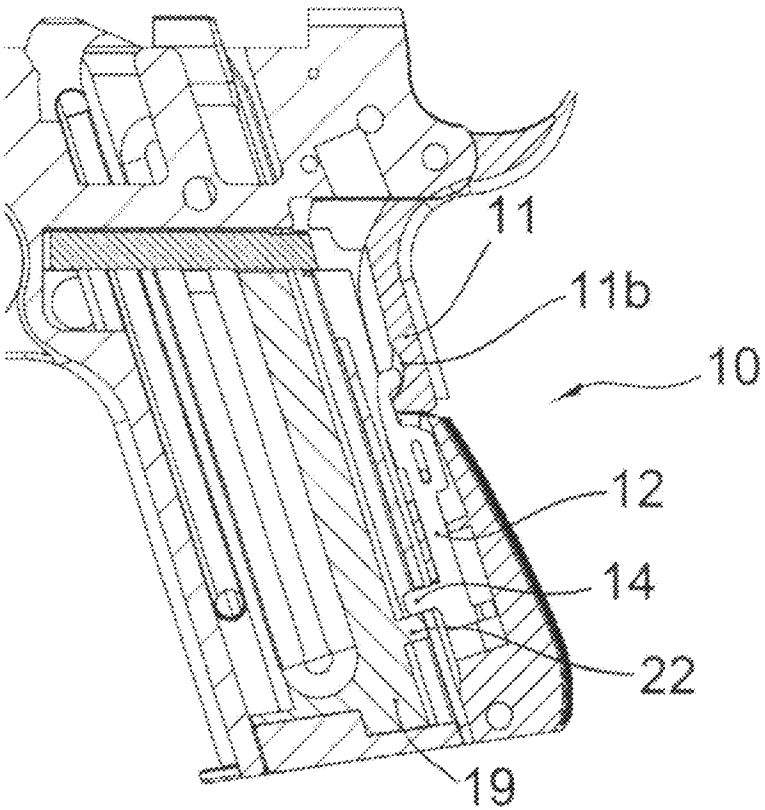
FIG. 2 a similar view to FIG. 1, but with a magazine inserted in the grip piece.
Figure 1:
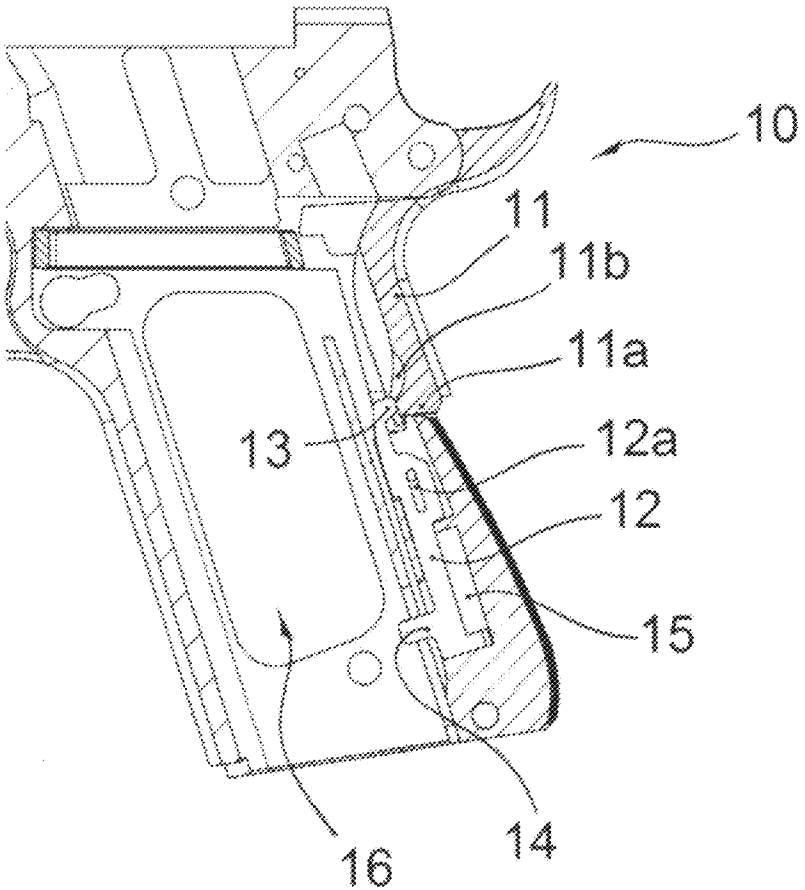
FIG. 1 a diagrammatically simplified vertical section through a firearm according to the invention in the region of the grip piece in longitudinal direction, with the magazine removed.

Reference is now made below to FIGS. 1 and 2 and with the aid thereof the mode of operation of the magazine security arrangement is explained in further detail. It can be seen that the grip piece 10, from which the magazine was removed, has a swivel part 11 designated as a grip security arrangement, which has on the inner side a nose 11*a* in the lower end region and a depression 11*b* lying thereabove. A magazine security plate 12 is mounted displaceably in the grip piece, for which a mounting 15 is provided in the grip piece 10, within which the magazine security plate can be displaced over a certain distance upwards from its lower position shown in FIG. 1. Here, a guide 12*a* is provided, in order to ensure a guided displacement on a defined path. This guide 12*a* for the magazine security plate 12 is, however, not absolutely necessary for the function and it can therefore also be dispensed with. The guide can, for example, also be provided solely by the inner wall of the grip piece and/or the magazine itself.

This magazine security plate 12, as can be seen, has in its upper end region a cam 13, which is aligned towards the exterior (i.e. contrary to the firing direction), whilst in the lower region on the magazine security plate 12 there is projection 14 directed towards the interior (i.e. in the firing direction), which projects into the magazine mounting 16 of the grip piece.

In the position shown in FIG. 1, the magazine security plate lies in its lower position, in which the upper cam 13 presses onto the nose 11*a* of the swivel part 11 of the grip security arrangement, so that his swivel part 11 is blocked and can not move inwards. The ball of the hand can therefore not be pressed in, so that a release of the trigger and hence a firing of a shot is not possible.

FIG. 2 now shows the position with the magazine 19 inserted. A projecting nose 22, facing towards the rear side of the weapon, is situated on the magazine 19 at some distance from the lower end, which nose, on insertion of the magazine, when the latter is almost fully inserted, engages under the projection 14 and thereby pushes the latter and the entire magazine security plate 12 a distance upwards. This leads to the cam 13 also moving upwards and thereby no longer pressing against the nose 11*a*, but rather arriving into the depression 11*b*. Thereby, the blocking of the swivel part 11 is cancelled. As the nose 11*a* now lies in the depression 11*b*, a swivel movement of the swivel part of the grip security arrangement is now possible. This can be pressed inwards, whereby the trigger is freed and a shot can be fired.

Figure 5:
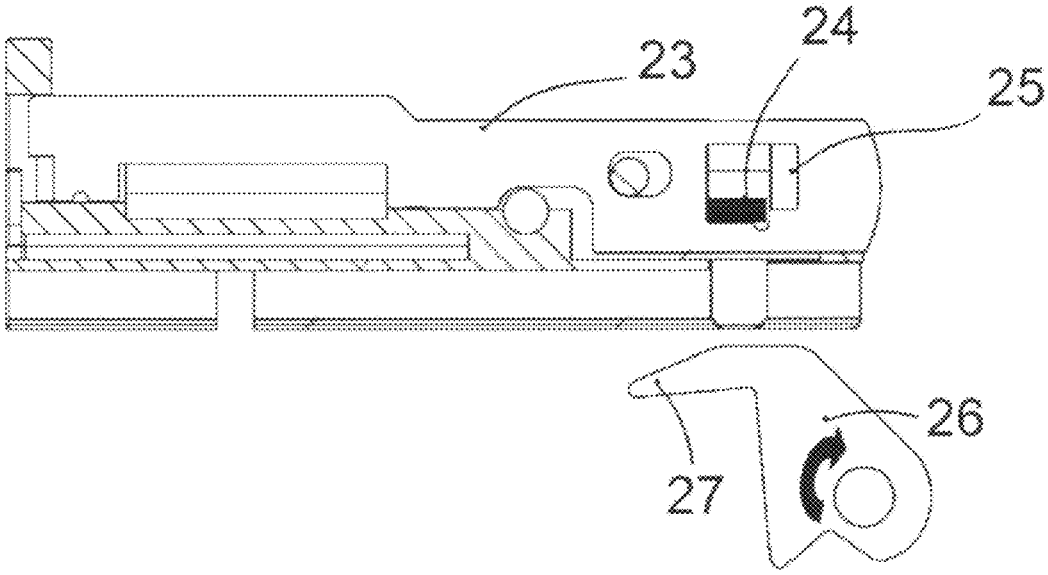
FIG. 5 shows a diagrammatically simplified view of a firing pin security arrangement according to the invention.
Figure 6:
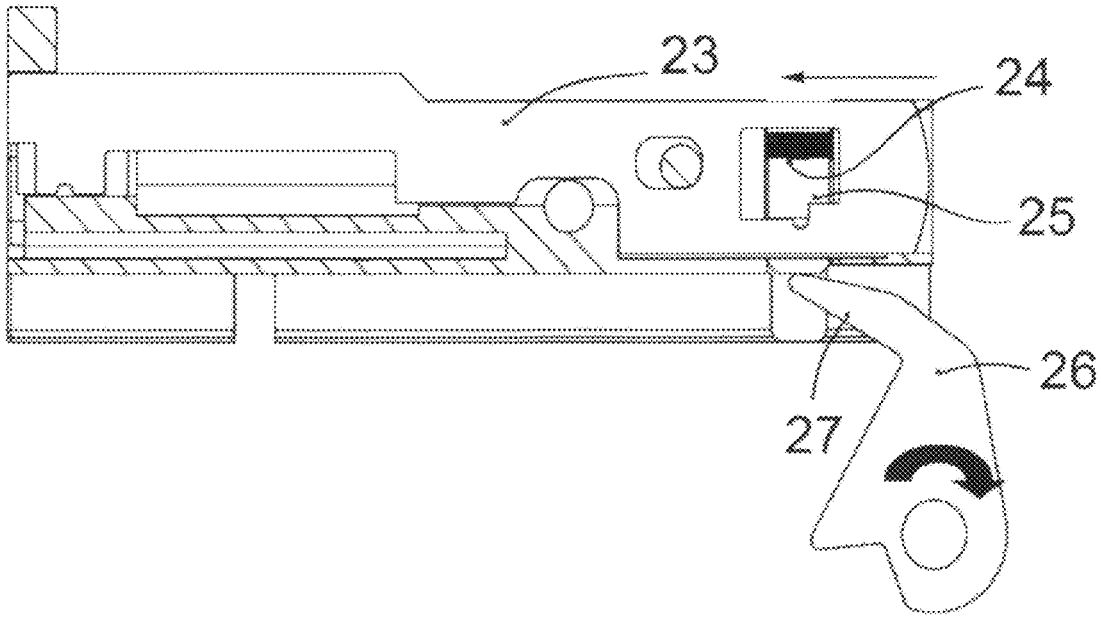
FIG. 6 shows a similar view to FIG. 5, wherein, however, the firing pin security element is situated in the unsecured position after actuation of the trigger.

An alternative example embodiment of the present invention is now explained in further detail below with reference to FIGS. 5 and 6. The illustration shows diagrammatically in a simplified manner a firing pin security arrangement comprising a firing pin security element 24, which is mounted so as to be vertically displaceable in a recess 25 of a firing pin 23 of the weapon. The recess 25 is narrower in the lower region and is wider in the upper region, so that a kind of undercut is produced. The firing pin security element 24 fits in an approximately fitting manner in its width into the lower, narrower region of the recess 25, so that a kind of form-fitting mounting takes place there. In the upper, wider region of the recess 25, on the other hand, the firing pin security element 24 has a path of movement transverse to its vertical displacement movement, i.e. in the direction of movement of the firing pin; this recess 25 in the upper region is wider than the firing pin security element 24.

Beneath the firing pin security element 24 there is situated a swivel part 26, connected with the trigger (not illustrated here), swivellable about an axis, with an arm 27. When the trigger of the weapon is now actuated, this swivel part 26 then swivels about its axis, whereby the arm 27 can move upwards from the secured position illustrated in FIG. 5 into the position illustrated in FIG. 6. Thereby, the lower end of the firing pin security element 24 is acted upon by the arm 27, and is displaced upwards and contrary to the firing direction (as can be seen by comparison of the two FIGS. 5 and 6), whereby the upper part of the firing pin security element 24 arrives out from the narrower region of the recess 25 into the wider, upper region of the recess 25. The firing pin 23 can now move a distance forwards and thereby fire a shot. In the secured position illustrated in FIG. 5, the firing pin is, on the other hand, blocked. It is thereby achieved that the firing pin is only free when the trigger is actuated, which means that a shot is prevented from being fired accidentally by percussion without actuation of the trigger, for example if the weapon falls to the ground. According to the invention, the firing pin security arrangement can be present in addition to the magazine security arrangement on the weapon.

LIST OF REFERENCE NUMBERS

10 grip piece
11 swivel part
11*a* nose
11*b* depression
12 magazine security plate
12*a* guide
13 cam
14 projection
15 mounting
16 magazine mounting
17 wider lower section
18 narrower upper section
19 magazine
20 wider lower section
21 narrower upper section
22 nose
23 firing pin
24 firing pin security element
25 recess
26 swivel part
27 arm

The invention claimed is:

1. A hand gun comprising at least one exchangeable magazine for cartridges, the magazine is insertable from below into a grip piece of the gun, the grip piece of the gun comprises a displace able security element so that when the at least one exchangeable magazine is removed, the security element blocks a grip security arrangement of the gun on the grip piece, and upon insertion of the magazine, the displace able security element is acted upon by a second element arranged on the magazine such that the displace able security element moves within the grip piece, wherein through the movement of the displaceable security arrangement, blocking of the grip security arrangement is released; and wherein the displaceable security element comprises an engagement element, which is associated with the second element projecting on the at least one exchangeable magazine, and in the insertion position of the at least one exchangeable magazine, the displaceable security element is acted upon by the projecting second element, and further including a blocking element arranged on the displaceable security element at a distance from the engagement element in an opposite end region of the displaceable security element, wherein the second element is arranged at a height in which the grip security arrangement is situated on the grip piece of the gun, with which the second element cooperates.

2. The hand gun according to claim 1, wherein the engagement element on the displaceable security element is a projecting element, and the corresponding second element on the magazine is a nose.

3. The hand gun according to claim 1, wherein the displaceable security element is a plate-like part, which is guided displaceably, tiltably or swivellably in the grip piece by a guide means.

4. The hand gun according to claim 1, wherein a projection of the displaceable security element serves as blocking element, which on displacement of the security element slips into a recessed region on an inner side of the grip piece, whereby a blocking of the grip security arrangement is cancelled.

5. The hand gun, according to claim 1, further comprising a firing pin security arrangement which blocks a movement of the firing pin on non-actuation of a trigger, wherein a recess is provided in the firing pin and the firing pin security element, guided displaceably in the recess, whereby a firing pin security element on actuation of the trigger of the weapon is acted upon directly by an arm of a swivel part connected with the trigger, and is displaced into a security release position.

6. The hand gun according to claim 5, wherein the recess has a narrower lower region, into which the firing pin security element engages in a form-fitting manner in a blocked state of rest, and a wider upper region, wherein a movement of the firing pin towards a front firing direction is only possible when the firing pin security element is in the wider upper region of the recess.

7. The hand gun according to claim 1, wherein the grip piece of a gun in a region of the at least one exchangeable magazine mounting, comprises a magazine security arrangement against interchanging of the magazine from a small caliber weapon magazine to a large caliber weapon magazine.

8. The hand gun according to claim 2, wherein the projecting element is a cam, a spring or a stop.

9. The hand gun according to claim 4, wherein the projection is in the form of a cam.

* * * * *